US007950201B1

(12) United States Patent
Adair, Jr. et al.

(10) Patent No.: US 7,950,201 B1
(45) Date of Patent: May 31, 2011

(54) UNDERDECK DRAINAGE

(75) Inventors: John D. Adair, Jr., Vail, CO (US); L. Paul Nelson, II, Richmond, VA (US)

(73) Assignee: OFIC North America Inc., Fredericksburg, VA (US)

( * ) Notice: Subject to any disclaimer, the term of this patent is extended or adjusted under 35 U.S.C. 154(b) by 0 days.

(21) Appl. No.: 12/498,435

(22) Filed: Jul. 7, 2009

Related U.S. Application Data

(62) Division of application No. 11/412,159, filed on Apr. 26, 2006, now Pat. No. 7,584,580.

(51) Int. Cl.

| | |
|---|---|
| ***E04B 1/00*** | (2006.01) |
| ***E04B 1/70*** | (2006.01) |
| ***E04B 2/00*** | (2006.01) |
| ***E04G 21/00*** | (2006.01) |
| ***E04D 1/00*** | (2006.01) |

(52) U.S. Cl. ..... 52/748.1; 52/748.11; 52/302.6; 52/506.06; 52/537

(58) Field of Classification Search ..... 52/11, 745.05, 52/747.1, 748.1, 748.11, 302.1, 302.3, 302.6, 52/465, 478, 506.05, 506.06, 533, 537
See application file for complete search history.

(56) References Cited

U.S. PATENT DOCUMENTS

| | | | | |
|---|---|---|---|---|
| 4,065,883 | A | 1/1978 | Thibodeau | |
| 4,083,153 | A * | 4/1978 | Sumpter | 52/28 |
| 4,663,894 | A | 5/1987 | LaRoche et al. | |
| 4,817,343 | A * | 4/1989 | Rutledge | 52/22 |
| 4,858,399 | A | 8/1989 | Salato, Jr. | |
| 4,860,502 | A * | 8/1989 | Mickelsen et al. | 52/11 |
| 5,195,281 | A | 3/1993 | Kosko | |
| 5,511,351 | A | 4/1996 | Moore | |
| 5,765,328 | A | 6/1998 | Moore | |
| 6,050,030 | A | 4/2000 | Wax, Sr. | |
| 6,164,019 | A * | 12/2000 | Salley | 52/11 |
| 6,212,837 | B1 * | 4/2001 | Davis et al. | 52/302.1 |
| 6,226,941 | B1 | 5/2001 | Stevens | |
| 6,226,956 | B1 * | 5/2001 | Davis et al. | 52/745.06 |
| 6,260,316 | B1 * | 7/2001 | Davis et al. | 52/302.3 |
| 6,279,271 | B1 | 8/2001 | Burkart, Jr. | |

(Continued)

OTHER PUBLICATIONS

Tuftex Corporation, "Tuftex Vinyl Panels—Underdeck Application Installation Guidelines", 2000, 2 pages printed from http://www.tuftexpanel.com/underdeckapp.htm on Jan. 24, 2006.

(Continued)

*Primary Examiner* — Basil Katcheves
*Assistant Examiner* — Andrew J Triggs
(74) *Attorney, Agent, or Firm* — Leading Edge Law Group, PLC

(57) ABSTRACT

Drainage under a deck can be performed by a structure that includes hanging components and corrugated panels. For example, a hanging component can have connected first and second portions, with the first portion being connected to hang from one of the joists and extending downward to where it connects to the second portion, which is below the joist. The second portion can be connected to support of at least one of the panels from above. The upper surfaces of panels are sloped so that drainage occurs from a high part to a low part. The direction of slope and the direction of corrugations are not perpendicular, and can be approximately the same. The hanging components can, for example, be L-shaped brackets, U-shaped, or inverted T-shaped, and can be integrally formed by extrusion of plastic or can be metal. The panels can be corrugated plastic or metal sheets.

13 Claims, 11 Drawing Sheets

U.S. PATENT DOCUMENTS

| | | | | |
|---|---|---|---|---|
| 6,308,479 | B1 | 10/2001 | Prohofsky | |
| 6,343,450 | B1 * | 2/2002 | Vance, Jr. | 52/302.1 |
| 6,385,931 | B1 * | 5/2002 | Risser | 52/302.1 |
| 6,393,785 | B1 * | 5/2002 | Burt | 52/302.3 |
| 6,415,571 | B2 * | 7/2002 | Risser | 52/302.1 |
| 6,421,967 | B1 | 7/2002 | Wlaker | |
| 6,688,059 | B1 * | 2/2004 | Walker | 52/302.3 |
| 6,694,686 | B2 | 2/2004 | Ready et al. | |
| 6,796,092 | B1 | 9/2004 | Goebel | |
| 6,886,302 | B2 * | 5/2005 | Jackson | 52/302.3 |
| 7,584,580 | B1 | 9/2009 | Adair, Jr. et al. | |
| 2002/0032990 | A1 | 3/2002 | Burkart, Jr. | |
| 2003/0029096 | A1 | 2/2003 | Burkart, Jr. | |
| 2004/0020136 | A1 | 2/2004 | Hauck | |
| 2004/0231260 | A1 | 11/2004 | Burkart | |

OTHER PUBLICATIONS

Tuftex Corporation, Brochure entitled "Enhance and Expand Your Living Space With Tuftex Panels", 2001, 4 pages.

Lowe's, Tear Pad Sheet entitled "Keep the Area Under Your Deck Dry and Looking Great in Three Easy Steps with . . . Tuftex Deck Drain", 2005, 2 pages.

"Undercover Systems, Inc., Patented, Clearspan Underdeck System", 2003, 8 pages, printed from http://www.undercoversystems.com on Jun. 3, 2005.

Decks Under Cover, "Welcome to Decks Under Cover", 2004, 10 pages, printed from http://www.decksundercover.com on Jun. 3, 2005.

Bradley, D., "New covers hide the ugly underside of decks", May 28, 2005, 2 pages, printed from http://www.southbendtribune.com on Jun. 3, 2005.

"Clean, dry, and beautiful", 2 pages, printed from http://www.print2webcorp.com on Jun. 3, 2005.

Aimed Corporation, "American Dry Deck—Stay Dry Under Your Deck!", 4 pages.

"Dry-B-Lo Int'l. Inc.—Installer of deck drain systems", 2005, 3 pages, printed from http://www.entrepreneur.com on Jun. 3, 2005.

"Is It Wet Below Your Deck?", 2002, 13 pages, printed from http://www.dry-b-lo.com on Jun. 24, 2002.

Truini, J., "Below-Deck Drainage", Popular Mechanics, Jul. 2002, pp. 111-112.

DrySpace, Inc., "DrySpace—The Deck Drainage Solution", 2004, 2 pages, printed from http://www.dryspace.cc on May 4, 2005.

"TimberTech Introduces DrySpace Decking Drainage System", Apr. 28, 2005, 1 page.

TimberTech , "Products—Create Usable Space Under Your Deck", 3 pages, printed from http://www.timbertech.com on Jun. 3, 2005.

Lowe's, "Finish What You Started—Underdeck" brochure, 2003, 2 pages.

Underdeck Inc., "Pro Series Installation Instructions", 2 pages.

"Underdeck Ceiling System Applications", 2000, 4 pages.

"Underdeck—Discover the Magic Under Your Deck!", 2004, 4 pages, printed from http:/www.underdeck.com on Jun. 3, 2005.

* cited by examiner

UNDERDECK DRAINAGE

This application claims priority as a divisional of U.S. patent application Ser. No. 11/412,159, entitled "Underdeck Drainage," now U.S. Pat. No. 7,584,580, incorporated herein by reference in its entirety.

BACKGROUND OF THE INVENTION

The present invention relates generally to drainage, and more particularly to drainage from under a deck.

Various devices have been proposed for draining water that passes through decks. U.S. Pat. No. 6,886,302, for example, describes a modular deck drainage system with channeled drainage panels mounted to direct water flow transversely of deck joists to a gutter. U.S. Patent Application Publication No. 2004/0231260 describes an under-deck grid-supported drainage system, and also describes previous shimming or sistering techniques. Other examples are described in U.S. Pat. Nos. 6,164,019; 6,212,837; and 6,308,479.

It would be advantageous to have improved techniques for drainage from under a deck.

SUMMARY OF THE INVENTION

The invention provides various exemplary embodiments, including structures, methods, and products. In general, the embodiments are implemented with hanging components and panels.

These and other features and advantages of exemplary embodiments of the invention are described below with reference to the accompanying drawings.

DETAILED DESCRIPTION

Figure 1:
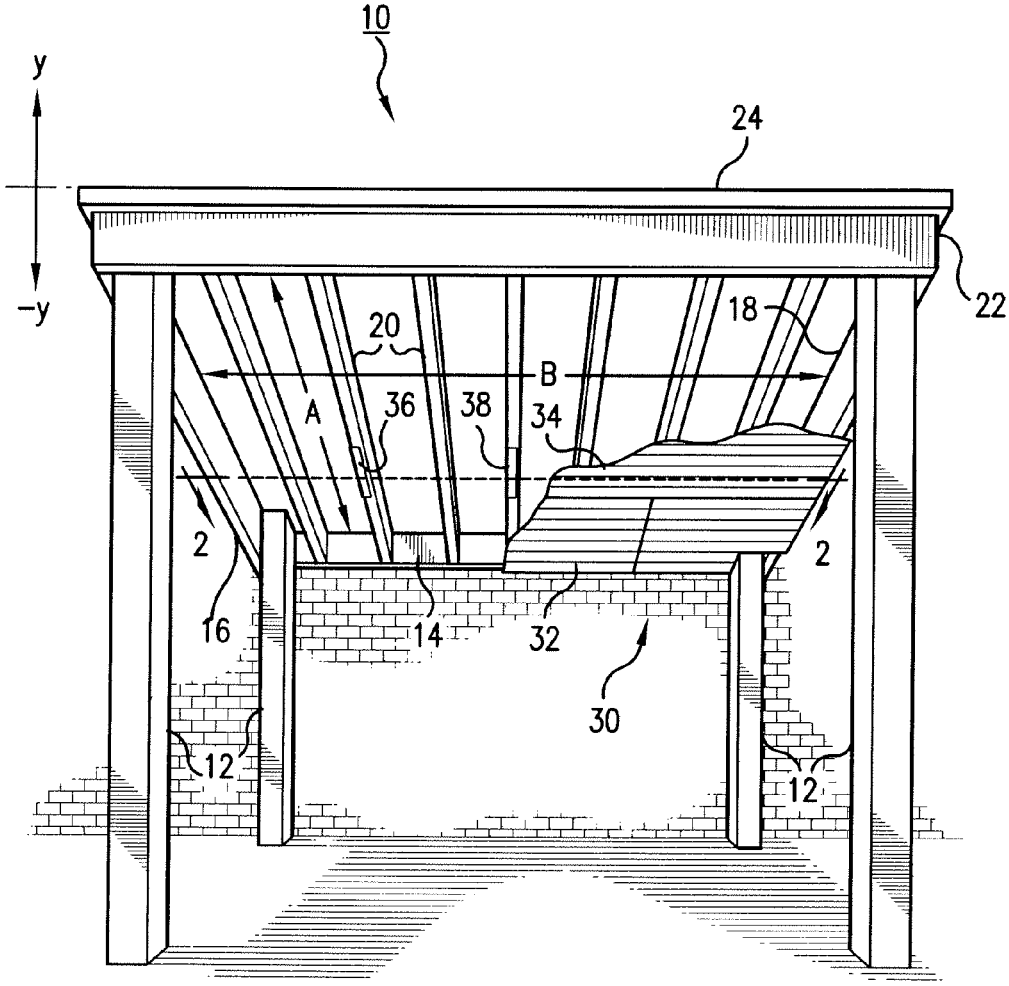
FIG. 1 is a schematic perspective view of a deck with a partially cutaway underdeck drainage structure.

In the following detailed description, numeric values and ranges are provided for various aspects of the implementations described. These values and ranges are to be treated as examples only, and are not intended to limit the scope of the claims. In addition, a number of materials are identified as suitable for various facets of the implementations. These materials are to be treated as exemplary, and are not intended to limit the scope of the claims.

The term "deck" is used herein to mean a floored structure, such as adjoining a house or other building or, possibly, freestanding; the floor of a typical deck is flat or nearly flat, and a typical deck is at least partially open to the elements—it could be roofless or it could be open or screened at its sides. A typical deck adjoining a house has a floor that permits liquid to pass through it, such as through gaps between deck boards, so that rainwater or other liquid falling or running onto the deck passes through the deck's floor into the area below the deck, sometimes referred to herein as an "underdeck area" or simply an "underdeck". Structures or actions that cause liquid passing through a deck's floor to flow across or out of the underdeck area are sometimes referred to herein as performing "drainage under a deck", or simply "underdeck drainage".

The exemplary implementations described below address problems that arise with underdeck drainage structures, especially where the underdeck area could be used as a patio or other useful area. Various structures have been proposed, but it has proven difficult to provide structures that are easy to install, that do not droop or otherwise extend downward into the underdeck area, and that direct water flow in a desired manner, such as in a single direction across the underdeck area. Specific problems that arise include obtaining appropriate slope and handling joists that are in some way uneven or irregular and/or impede water flow.

In general, the implementations described below involve combinations of parts or components. As used herein, a "structure" is a combination of one or more parts or components that form a whole, such as by being connected together or by being connected to another structure, part, or component.

A "sheet component" or "sheet" is a component that is thin in comparison to its length and breadth. A "panel" is a sheet that can form part of a surface. For example, a set of panels in a structure can each have an "upper surface", meaning a surface that is disposed upward, away from the ground; the upper surfaces of a set of panels together can provide a surface across which liquid can drain, sometimes also referred to herein as an "upper surface" or a "drainage surface".

In the implementations described below, sheets and panels are used that have corrugations. As used herein, "corrugation" refers to any sort of ridge, valley, channel, or groove that extends across a sheet component such as a panel; examples of corrugations include shapings of a sheet component that provide one or more ridges or valleys, one or more channels, or one or more grooves. A sheet component is referred to as "corrugated" if it includes any such ridge, valley, channel, or groove. A corrugation is described as "extending in" a given direction if it maximally departs from a sheet component's mean plane along a line that extends in the given direction, sometimes referred to herein as a "corrugation direction"; the direction in which a corrugation extends need not be straight, and could instead be curved or angled, for example.

Corrugations offer the distinguishing functions both to collect liquid from the upper surface of a panel into valleys, grooves, or channels and also to direct the flow of liquid in the direction in which the valleys, grooves, or channels extend and, more specifically, in the direction of downward slope, sometimes referred to herein as a "slope direction". Although the implementations described herein do not require that the direction of downward slope of the structure be exactly the same as the direction in which corrugations extend, drainage is enhanced if the two directions are approximately the same. On the other hand, drainage can occur even if the two directions are different as long as they are not perpendicular and the resulting slope in the direction of the corrugations is sufficient to overcome adhesion between liquid and the upper surface of the panel. In some of the installation processes as described below, it is assumed that the lower surfaces of brackets are substantially horizontal and that panels have regular corrugations such that the direction of slope and the direction of the corrugations is substantially the same.

In addition to the functions described above, corrugations can also advantageously provide greater strength. A sheet component such as a panel with corrugations typically resists bending along a line perpendicular to the corrugations.

A "hanging component" or a "hanger" is a component that can be used to hang one part or component from another. A "bracket" is a hanger with a bracket-like or similar shape, such as an L-shape, an inverted T-shape, or a U-shape.

In the implementations described below, parts or components of structures are referred to as "attached" to each other or to other structures, parts, or components or vice versa, and operations are performed that "attach" structures or parts or components of structures to each other or to other things or vice versa; the terms "attached", "attach", and related terms refer to any type of connecting that could be performed in the context. One type of attaching is "mounting", which occurs when a first part or component is attached to a second part or component that functions as a support for the first; for example, a panel can be "mounted" on a bracket. Similarly, "fastening" occurs when a part or component attaches two or more other parts or components to each other; for example, a screw, nail, bolt, staple, or other such component or glue, cement, a welded or soldered bond, or adhesive structure such as a tape could "fasten" a panel to a bracket. In contrast, the more generic term "connecting" includes not only "attaching", "mounting", and "fastening", but also making other types of connections such as between or among parts formed as a single piece of material by molding or other fabrication, in which case connected parts are sometimes referred to as "integrally formed".

A structure may be characterized by its function, such as a "drainage structure" that can perform drainage, and so forth. Similarly, the parts or components of a structure can also be characterized by function: A part or component of a structure can, for example, be a "fastener", meaning a part or component that fastens at least two other parts or components to each other.

A typical deck adjoining a house is a structure that includes "joists" and "floor boards", related as follows: The joists (sometimes called "rafters") support the floor boards from underneath, and joists are typically implemented as parallel boards with their narrow sides upward; with current construction standards, typical joists are approximately 2" thick with center lines of adjacent joists 16" apart, but various other possible spacings could be used, including 12", 14", 18", or 24". The floor boards are attached to the upward sides of the joists, but with wide sides upward to provide the deck's floor.

A deck provides an orientation framework as follows: "Upward" and "downward" refer respectively to vertical directions away from and toward the ground below a deck. "Under" and "over" a deck mean, respectively, under and over the floor of the deck; therefore, joists of a deck are referred to herein as under the deck. "Lateral" refers to a direction that is approximately perpendicular to vertical; therefore, a lateral-facing side of a joist is sometimes referred to herein as a "lateral surface".

FIG. 1 shows deck 10. Deck 10 includes posts 12 with lower ends supported directly or indirectly on the ground or other underlying support adjacent a building, one wall of which is in the background in FIG. 1. Header board 14 is attached to the wall of the building and extends between two of posts 12 that are immediately adjacent to the wall. Extending away from and approximately perpendicular to the wall is a set of joists, each of which is connected at one end to header board 14. Outer joist 16, sometimes referred to below as the "first joist", is at the left in FIG. 1, while outer joist 18, sometimes referred to herein as the "last joist", is at the right. Inner joists 20 are substantially parallel to outer joists 16 and 18, and the spacings between adjacent joists are approximately equal across deck 10.

The ends of joists 16, 18, and 20 opposite header board 14 are connected to end board 22, which is also supported on two of posts 12 that are at a distance from the wall of the building. Joists 16, 18, and 20 in turn support floor boards, including floor board 24, illustratively shown as a continuous board parallel to end board 22; in general, floor boards could have any suitable shape and could extend in any suitable direction in which they are adequately supported by the joists, with gaps or other suitable spaces between the floor boards. As shown in FIG. 1, distance in vertical directions can be measured along a y-axis with its origin at the upper surface of the floor boards and with the positive y-direction extending upward from the origin while the negative y-direction extends downward.

Deck 10 is illustratively rectangular, extending in a lateral direction perpendicular to the building wall a distance A, and extending in a lateral direction parallel to the building wall a distance B. As a result, posts 12 are positioned at the corners of an A×B rectangle. The exemplary implementations described below, however, could be applied to a deck with any suitable shape, supported on any appropriate number of posts positioned in any appropriate way. For example, the posts need not be positioned precisely at the corners of the deck, and one or more of the posts could, for example, be positioned inward from a corner or along an edge of the deck but away from corners.

Drainage structure 30, which is partially cut away in FIG. 1, is attached under floor board 24 and the other floor boards, so that it performs drainage under deck 10. Drainage structure 30 includes corrugated panels 32 and 34 as well as other corrugated panels as described in greater detail below; as can be seen in FIG. 1, panels 32 and 34 are "under the joists" of deck 10, meaning that they are under the lower surfaces of joists that are above them. Drainage structure 30 also includes brackets 36 and 38 as well as additional brackets, as described below.

Figure 2:
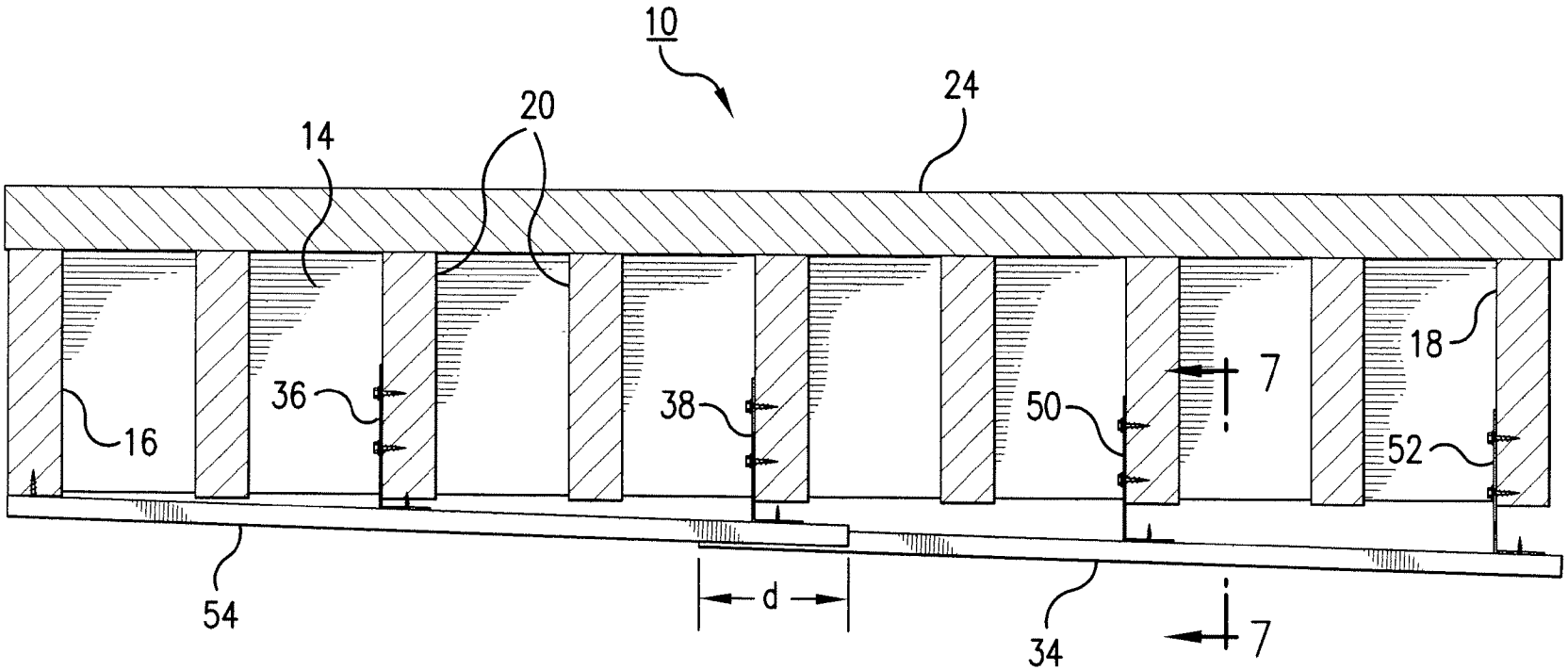
FIG. 2 is a partially schematic cross-sectional view of a deck as in FIG. 1, taken along line 2-2.

FIG. 2 shows a cross section of deck 10, taken along the line 2-2 in FIG. 1. In the background is header board 14, while floor board 24 is at the top, supported by joists 16, 18, and 20. In addition to brackets 36 and 38, brackets 50 and 52 are attached to respective joists. Corrugated panels 34 and 54 are, in turn, attached to brackets 36, 38, 50, and 52. In addition, corrugated panel 54 is attached to first joist 16 without a bracket or other hanging component.

Each of brackets 36, 38, 50, and 52 illustratively has an L-shape, with two legs that are approximately perpendicular, with one being substantially vertical and the other extending in a lateral direction. As described in greater detail below, brackets 36, 38, 50, and 52 are positioned so that the upper surfaces of panels 34 and 54 together form a sloped drainage surface that illustratively slopes from a high end at joist 16 downward to a low end at joist 18. In addition, panels 34 and 54 overlap by a distance d, with panel 54 over and on top of panel 34 in the overlapping region. The lapping relationship shown in FIG. 2, with corrugated panels 34 and 54 overlapping at their ends in the corrugation direction, is sometimes referred to herein as "end lap".

A surface is described herein as having "slope", as "sloping", or as being "sloped" if the surface deviates from horizontal sufficiently that water or other relevant liquid runs across the surface from at least one position to at least one other position. A surface is "uniformly sloped" if, at all points of the surface, the slope is in substantially the same direction with substantially the same angle from horizontal. A surface that is uniformly sloped can be characterized by a distance of "fall" per distance of "run"; for example, the slope could provide a fall of 1" per 10' of run, equivalent to a slope magnitude of 1/120.

Figure 3:
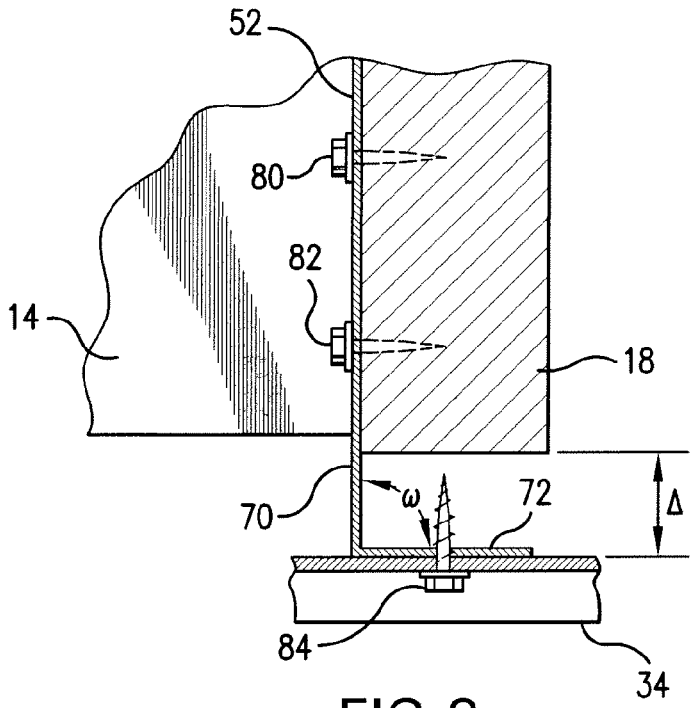
FIG. 3 is a detail of the cross section in FIG. 2, showing one joist with an attached bracket and panel.

FIG. 3 shows in greater detail the portion of FIG. 2 that includes joist 18, bracket 52, and a portion of panel 34, again with a portion of header board 14 in the background. Vertical leg 70 and lateral leg 72 of bracket 52 are illustratively connected at an angle ω, which is approximately 90° and could range between approximately 85° and approximately 90°.

Vertical leg 70 is fastened to joist 18 and extends downward to where it connects to lateral leg 72. Vertical leg 70 and joist 18 are fastened by screws 80 and 82, each of which is illustratively a conventional aluminum deck screw implemented with a length of approximately 1", with a hex head, and with one or more washers under the head; in principle, any other suitable screws, nails, bolts, staples, glue, cement, a welded or soldered joint, adhesive tape, or other fasteners could be used instead of screws 80 and 82, and it is not necessary that screws 80 and 82 be similar to each other. Furthermore, any suitable number of fasteners could be used. For improved appearance, the visible portions of the fasteners could be painted to match the color of the panels.

Screws 80 and 82 provide an example of how a first portion of a hanging component, i.e. vertical leg 70 of bracket 52, can be "connected to hang from" a respective joist. In the illustrated example, bracket 52 hangs from joist 18. This is also an example of an implementation in which a hanging component is connected to support at least one panel "from above", which refers herein to any arrangement in which a hanging component supports a panel only through connections at or above the panel's upper surface. If a hanging component is connected to support a panel from above and provides sufficient support, it may be unnecessary to support the panel in any other way; as a result, it may not be necessary for any part or component to extend downward between adjacent panels, so that adjacent panels can overlap.

Panel 34 is fastened to lateral leg 72 by screw 84, which is illustratively implemented the same as screws 80 and 82 but which could similarly be implemented with any other suitable fastener. This fastening results in a downward distance from the lower surface of joist 18 to the lower surface of lateral leg 72, the downward distance being labeled Δ in FIG. 3 and being measured in the negative y-direction (FIG. 1). Note, however, that bracket 52 could alternatively be connected with lateral leg 72 extending away from joist 18 rather than under it as shown, in which case downward distance Δ could be measured, for example, from a horizontal line tangent to the lower surface of joist 18 downward to the lower surface of lateral leg 72. In this and other examples, downward distance Δ may vary due to variations in the lower surface of joist 18 or in the lower surface of lateral leg 72, which may not extend horizontally, such as due to an angle where it connects to vertical leg 70.

As described in greater detail below, a hanging component's lower surface may be sloped in a given direction, such as the lengthwise direction of a joist. In such cases, it can be said that the downward distance "slopes" in the direction.

The connections made by screws 80, 82, and 84 are examples of one part or component being "connected at" a surface of another, meaning that the connection holds the one part or component at the surface of the other even though the connection may or may not actually bind the part or component to the surface as would glue, cement, tape, melted adhesive, a weld bead, a solder bead, or other such bonding fastener. Specifically, vertical leg 70 is connected at a lateral surface of joist 18 by screws 80 and 82 (and possibly additional fasteners not shown), while lateral leg 72 is connected at an upper surface of panel 34 by screw 84 (and possibly additional fasteners not shown).

Although downward distance Δ is illustrated as a single distance in FIG. 3, situations may arise in which downward distance Δ varies as a function of position on the lower surface of a joist or position on the lower surface of a lateral leg or other portion of a hanging component; for example, the lower surface of a joist might not be uniform or completely level or a bracket or other hanging component might be sloped along the length of a joist or might have a lateral leg that does not extend horizontally from where it connects to a vertical leg. As used herein, the expression "downward distance below" a joist's lower surface includes situations in which the downward distance is a function of position, such as position on the joist's lower surface or position on a lateral leg's lower surface, and does not require that the downward distance be constant at all positions or that downward distance be measured directly from the joist's lower surface or in any other specific way. Similarly, a lateral leg or other portion of a bracket or other hanging component "has downward distance below" or is simply "below" a joist if positions on the lower surface of the lateral leg or other portion are at downward distances below the joist's lower surface when measured in one of the ways described above or any other appropriate way, whether or not the downward distances are equal or approximately equal. Furthermore, although the lower surfaces of the joists are shown in FIG. 2 as being in substantially a single plane, the widths of joists may vary, so that downward distance below one joist's lower surface must be adjusted independently of the downward distance below another joist's lower surface in order to obtain a uniformly sloped drainage surface.

Figure 4:
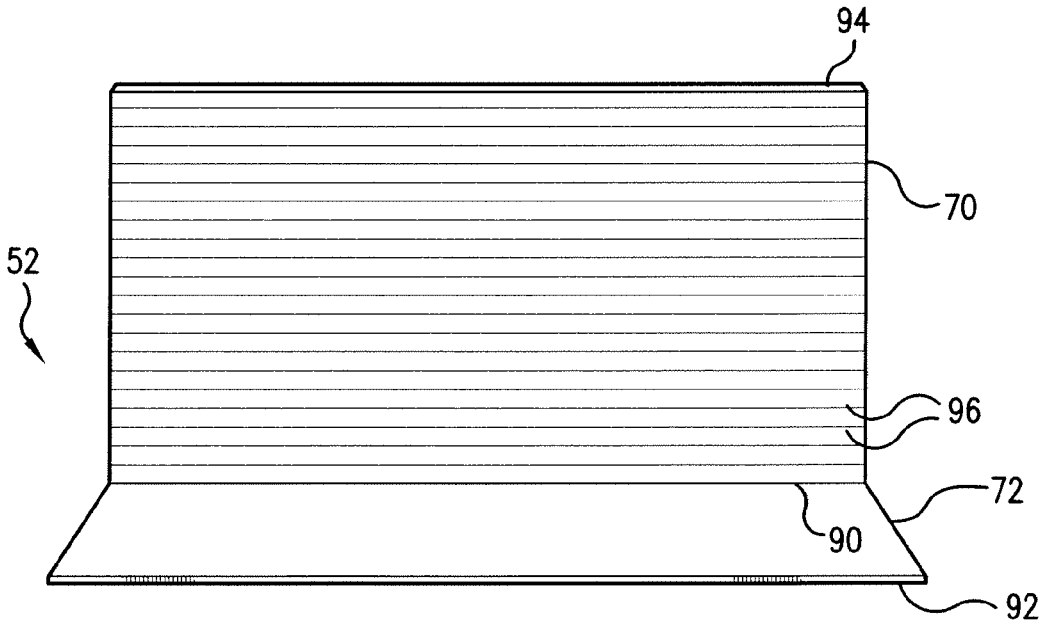
FIG. 4 is a partially schematic perspective side view of a bracket as in FIGS. 2 and 3.

The connection between vertical leg 70 and lateral leg 72 of bracket 52 in FIG. 3 illustrates an example of components that are connected by being integrally formed. FIG. 4 illustrates bracket 52 in a perspective view that shows several of its features. As can be understood from FIG. 4, bracket 52 could be produced by extruding plastic through a die with an appropriate L-shaped opening, and inverted T-shaped and U-shaped hangers could similarly be produced by extruding plastic through an appropriately shaped opening in a die. Bracket 52 is illustratively extruded vinyl, but could be any other suitable material, including various other plastics, metals, or even wood, and could be produced in various ways other than extrusion, possibly including techniques in which parts such as vertical leg 70 and horizontal leg 72 are produced separately and then attached to each other such as by fastening.

In the exemplary implementation shown in FIG. 4, bracket 52 has a thickness of approximately 60 mils or more, a sufficient thickness that it holds its shape despite small forces, even though it flexes in response to larger forces. The thickness need not be completely uniform, and there could, for example, be a slight thinning near the upper edge of vertical leg 70. Also, vertical leg 70 could be slightly thinner than lateral leg 72. It is beneficial, however, if legs 70 and 72 are sufficiently rigid and sufficiently connected along connection line 90 that lateral leg 72 is not significantly deflected by the weight it supports through its connections at the upper surface of panel 34. The weight it supports will include not only part of panel 34, but also possibly parts of adjacent overlapping panels and the weight of liquid as it drains across the upper surfaces of the panels; in cold climates, the weight of ice on the upper surfaces may also be supported by the brackets.

As described above in relation to FIG. 3, the angle ω at connection line 90 can be in a range of approximately 85° to 90°; brackets similar to bracket 52 have been successfully implemented with angles slightly smaller than 90°, the slightly acute angle providing additional resistance to drooping due to weight on lateral leg 72. Angles significantly smaller than 90° can result in problems in fastening panels to brackets, however, so that the angle ω must be chosen to permit effective fastening.

Various techniques could be used to produce bracket 52 with a desired angle ω. For example, in a differential cooling technique, one could use an extrusion die that is cut to provide 90° or another appropriate angle between legs 70 and 72; during cooling, a bead of colder water could be drawn down the inside of bracket 52 to produce a different rate of cooling that results in the desired angle. In another approach, an extrusion die could be cut to provide the desired angle directly.

In the illustrated implementation, the width between connection line 90 and lateral edge 92 of leg 72 is approximately 1.75", while the width between connection line 90 and upper edge 94 of leg 70 is approximately 5". Bracket 52 is illustratively a 7" portion of a bracket. The surface of leg 70 above leg 72 has score lines 96, which have been successfully implemented as continuous, short ridges extending the full length of bracket 52. Score lines 96 are approximately parallel to connection line 90 and are illustratively uniformly spaced approximately 0.25" apart. Score lines 96 can serve as a guide to keep bracket 52 straight and to position it to obtain a desired downward distance Δ while attaching bracket 52 to joist 18, as described in greater detail below. The dimensions of the implementation shown in FIG. 4 are merely illustrative, and could be varied across appropriate ranges for particular applications. In a commercial implementation, for example, brackets similar to bracket 52 have been marketed with lengths of 5' for ease of use and shipping, and with instructions indicating that they can be cut to fit a particular deck. In addition, the shape of a hanging component or hanger need not be bracket-like, as illustrated by the examples below.

Figure 5:
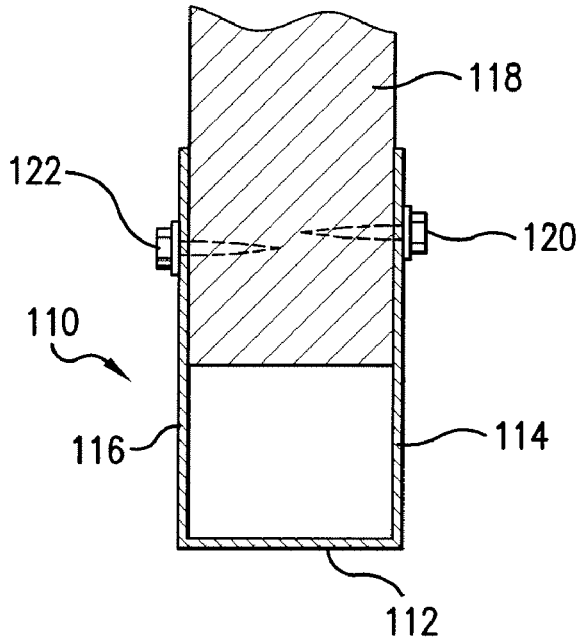
FIG. 5 is a cross-sectional view of a U-shaped hanging component connected at opposite lateral surfaces of a joist.

FIG. 5 shows hanger 110, a U-shaped structure with a base 112 and, at each side of the base, one of legs 114 and 116. Legs 114 and 116 are connected at lateral surfaces of joist 118 by screws 120 and 122, respectively. Legs 114 and 116 can be positioned so that base 112 is approximately level. Compared to an L-shaped bracket, hanger 110 further reduces the risk of droop due to weight on a panel and therefore is likely to last longer and hold more weight.

Figure 6:
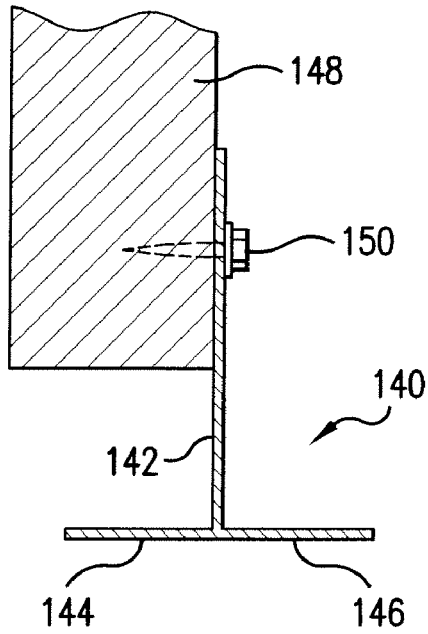
FIG. 6 is a cross-sectional view of an inverted T-shaped hanging component connected at a lateral surface of a joist.

FIG. 6 shows hanger 140, with an inverted T-shape. Vertical leg 142 is connected to lateral arms 144 and 146. Leg 142 is connected at a lateral surface of joist 148 by screw 150. Compared to L-shaped and U-shaped hangers as described above, hanger 140 has a larger lower surface area to which a panel can be attached, allowing more flexibility in its application.

Figure 7:
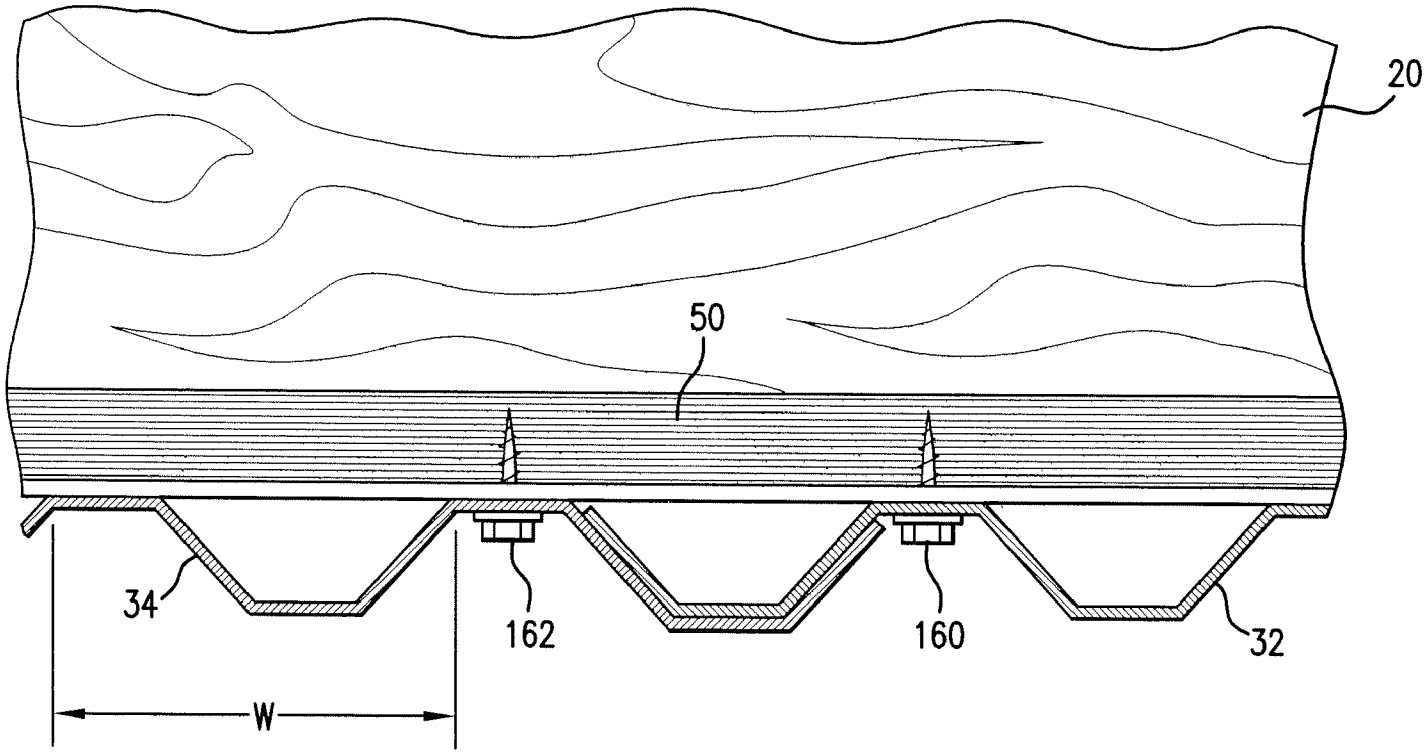
FIG. 7 is a cross-sectional view of the underdeck drainage structure of FIG. 2, taken along the line 7-7.

FIG. 7 shows a cross section of FIG. 2 taken along the line 7-7. Although relevant primarily to an L-shaped hanger like bracket 50 in FIG. 2, features shown in FIG. 7 would also be found in implementations with differently shaped hangers 110 and 140 as in FIGS. 5 and 6 or with other hanging components.

In FIG. 7, another kind of lapping relationships is shown, a "side lap", i.e. a relationship between corrugated panels that overlap at the sides that are lateral to their corrugations. Specifically, panel 34 overlaps at one side with adjacent corrugated panel 32 in another row, as suggested in FIG. 1. As a result of end lap (FIG. 2) and side lap (FIG. 7), water on the upper surface of the panels cannot fall through between panels, but remains within the corrugations and drains across the upper surface in the slope direction.

FIG. 7 illustrates one of many ways in which side lap can be implemented. As shown, panel 34 side laps one corrugation valley of panel 32. In the illustrated example, panel 32 was first positioned, and screw 160 was then used to connect bracket 50 at the upper surface of panel 32. Then panel 34 was positioned with one corrugation valley side lapping panel 32, and screw 162 was then used to connect bracket 50 at the upper surface of panel 34.

Various other approaches to side lapping could be used. For example, in another possible approach, screw 160 (or another screw further from the side lap) could be used first to connect panel 32 to bracket 50, after which panel 34 could be inserted between panel 32 and bracket 50 to obtain side lap and then screw 162 could be used to connect panel 34 to bracket 50. In other possible approaches, panels 32 and 34 could overlap further or differently, and one or more screws could extend through both of them into bracket 50. For example, if the side lap approach in FIG. 7 is characterized as "single lapping", then "double lapping" with two overlapping corrugation valleys, "triple lapping" with three, and so forth may provide greater sturdiness and reduce the likelihood of leaking when a large amount of water falls through a deck.

Similarly, the shape of a deck may constrain the choice of an approach to side lapping. For example, greater side lapping may make it possible to reduce the number of panels that must be cut for a specific deck, allowing quicker installation with greater side lapping. Similar considerations can also apply to end lapping.

FIG. 7 also shows that each of panels 32 and 34 includes at least one corrugation in its upper surface. Underdeck drainage structures have been successfully implemented, for example, using Tuftex UltraVinyl™ sheets from Tallant Industries, Inc. of Fredericksburg, Va. Each Tuftex UltraVinyl™ sheet could, for example, have approximate dimensions of 26" wide, 10' long, and 30-32 mils thick; the 10' length fits well, for example, if joists are 16" apart on center. They could be opaque or translucent. They could have regular corrugations with periods having an average width W as shown in FIG. 7; for example, W could be approximately 2.6". The corrugations could have any appropriate shape, whether regular as shown or irregular, including an angled wave as shown, a round or sinusoidal wave, a square wave, a V-shaped wave, or any suitable combination of one or more types of waves.

Corrugations are "regular" if they extend in a straight direction and have approximately equal-width periods measured similarly to W as shown in FIG. 7. More specifically, W is measured in a direction "transverse to the corrugation direction", meaning it is measured in a direction that extends across the corrugation direction and is substantially perpendicular to the corrugation direction where they cross.

Figure 8:
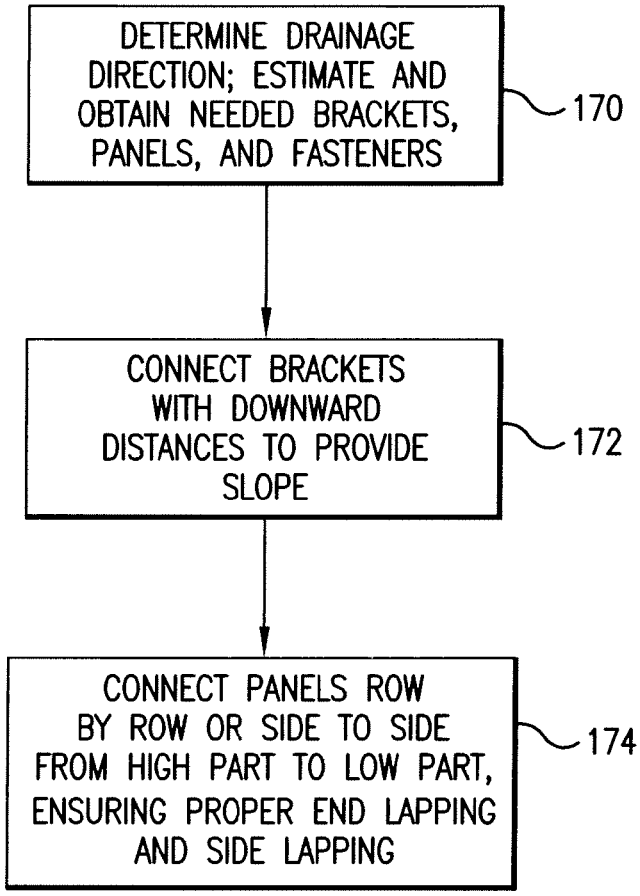
FIG. 8 is a flowchart of operations performed in installing an underdeck drainage structure similar to those described in relation to FIGS. 1-7.

FIG. 8 illustrates one sequence of operations that can be performed to install an underdeck drainage structure similar to structure 30 as described above. The installation process illustrated in FIG. 8 has been successfully implemented on many different decks, and is especially well suited to a rectangular deck that is sufficiently small and sufficiently high above the ground that a single sloping upper surface can provide sufficient underdeck drainage.

The operations in box 170 involve preparation for installation. One preparatory operation is to determine the drainage direction, while another is to estimate and obtain the materials that are needed.

A drainage direction can be chosen by trying to best satisfy a number of constraints. As a general rule, water should not flow toward the house or other building adjacent the deck. Similarly, the position of the deck relative to the ground or other nearby structures may indicate a preferred destination for drained water. Furthermore, for ease of installation, it may be best if the drainage direction is perpendicular to the deck's joists, because the corrugations normally extend perpendicularly to the joists. It should be noted, however, that it is also possible to install panels with corrugations parallel to joists, as described below; for example, shimmed pieces, such as wood, can be attached perpendicular to the joists to provide a lattice-like structure to which panels can be attached, or brackets can be attached to joists with appropriate slope and standard sized cross pieces, such as wood or plastic, can be attached to the brackets, as described below.

If the deck is so large that more than one sloping surface is necessary to drain it, two substantially opposite drainage directions can be chosen, so that the panels will slope downward in two directions from a high part, which can, for example, be at the center of the deck. But if only one sloping surface is needed for underdeck drainage of a rectangular deck, the choice of a drainage direction also includes selection of a high end and a low end of the deck.

The necessary materials can be estimated based on the area of the deck and the sizes of the brackets and panels. With a rectangular deck as shown in FIG. 1, the total number of square feet of underdeck area can be obtained by multiplying A and B, and this area can be increased by approximately 5-10% to allow for end laps. If using panels 26" wide, the adjusted underdeck area can be divided by two to obtain a number of linear feet of panels that are needed, allowing for side laps. The number of linear feet needed can then be divided by the length of the panels and rounded up to the next whole number to obtain an approximate number of panels that are needed. If the deck is 9'×10', for example, and panels 10' long are used, this calculation would yield five panels.

The number of brackets needed can be estimated based on the lengths of joists in the deck and the number of joists that will have brackets attached to them. For example, if brackets are attached to every other joist as illustrated in FIG. 2, the total length needed can be estimated by multiplying half the number of joists by the length of one joist. This length can then be divided by the lengths of the brackets to obtain the number of brackets that are needed. For example, if there are nine joists and each joist is 9' long, while 5' brackets are used, it would be appropriate to obtain at least nine brackets. As described below, additional brackets may be needed to support end laps, and it may be advantageous to plan the entire job and determine the additional bracket length needed before obtaining the brackets.

The number of screws may be estimated based on the number of panels. For example, in mild climates where icing is unlikely, 30-40 screws may be sufficient to fasten each panel that is 10' long. If the climate is more severe, with heavy icing, it would be prudent to use more screws per panel. Assuming a total of five panels, 40 screws per panel, and 100 screws in a box, then at least two boxes of screws would be needed.

The operations in box 172 connect brackets to joists. The brackets function to provide a surface at which the panels can be attached and also to provide slope so that water will flow in the desired drainage direction determined in box 170. The slope is obtained by positioning the brackets so that their lower surfaces have appropriate downward distances, measured as illustrated by the distance Δ in FIG. 3. In addition, the magnitude of the slope must be sufficient that water will flow in the desired drainage direction. Experience has shown that the slope magnitude should be no less than approximately 1/120, or 1" of fall for every 10' of run. For joists that are 16" apart on center, this is equivalent to approximately ¼" of fall across 2 joist spaces, i.e. the distance between adjacent score lines 96 as shown in FIG. 4.

Various techniques could be used to position brackets for attachment to joists with appropriate downward distances. One especially simple technique that has proven successful in building many decks is as follows: First, tap a nail into the lower surface of first joist 16 (FIGS. 1 and 2) and secure a string to the nail at the lower surface of joist 16. Then, secure a nail or dowel into the lower surface of last joist 18 (FIGS. 1-3), and pull the string tight and secure it to the nail or dowel at the proper downward distance to obtain the desired slope magnitude along the length of the string. With the string pulled tight between the first and last joists, align a bracket on the second joist inward from first joist 16, i.e. the third joist from the high end of deck 10. The bracket should touch or rest on the string without deflecting the string. With the bracket aligned, screws are then used to fasten the vertical leg of the bracket to the lateral surface of the joist. As suggested in FIGS. 2 and 3, the alignment may be optimal if vertical leg 70 is on the lateral surface of the joist disposed toward the high end of deck 10. The same bracket attachment steps can then be performed on the fifth joist, the seventh joist, and so forth until last joist 18. If all brackets are attached with appropriate downward distances, the lower surfaces of the brackets should all touch or rest on the string.

This procedure compensates for uneven joists, and can be implemented with more than one string along the lengths of the joists for easier alignment of brackets. Various other alignment techniques could be used, including, for example, visually aligning the score lines 96 on the brackets with the lower surfaces of the joists, which is more likely to be successful if the lower surfaces of the joists are relatively even.

In fastening the brackets, a level or other suitable technique can be used to ensure that the lower surface of each bracket is level. Also, once one of the brackets is attached to a joist, adjacent brackets can be attached to the same joist with their lower surfaces level with that of the first bracket. When necessary, a bracket can be cut to an appropriate length to complete coverage of a joist. In addition to fastening brackets to every other joist beginning with the third joist as described above, additional brackets can be attached wherever end lap will occur, to make it possible to fasten the overlapping panels; alternatively, additional brackets could later be fastened to joists where end laps occur. In an alternative approach, a bracket can be fastened to every joist or to every joist except the first joist at the high end of the deck. In examples described below, brackets can be attached to every joist, and the corrugation direction can be approximately the same as the lengthwise direction of the joists. Cross pieces, as described below, can be connected between the brackets and the panels, connected to the panels in a way that prevents panels from sagging, such as due to the weight of water on the upper surface.

The operations in box 174 connect panels to the joists row by row or side to side, with the panels in each row being connected from the high part of deck 10, the end shown at left in FIG. 2, to the low part, the end shown at right in FIG. 2. The panels are connected in positions to ensure proper end lapping and side lapping. Although the panels could be connected in other sequences, the row by row sequence described below has been successfully performed to obtain satisfactory underdeck drainage for many decks.

Figure 9:
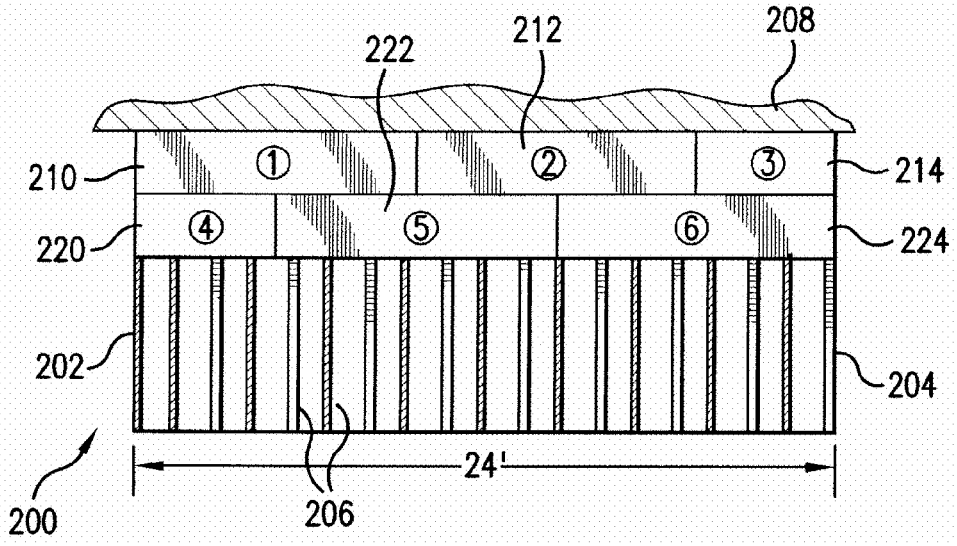
FIG. 9 is a schematic view from under a deck, showing a stage in the installation process of FIG. 8.

FIG. 9 illustrates how panels can be connected to joists row by row. Deck 200, viewed from underneath, has first joist 202 at its high end and last joist 204 at its low end, with intermediate joists 206 in between. In the illustrated example, there are a total of 19 joists, and the total width of the deck between joists 202 and 204 is 24'. Prior to connecting the panels, brackets have been connected to joists as described in relation to box 172 in FIG. 8, and joists without brackets are shown in FIG. 9 with diagonal shading, while joists with brackets are shown with partial lateral shading to suggest the presence of brackets. The first two rows of panels adjacent to building wall 208 have been connected, and additional rows remain to be connected.

The first row of panels includes panels 210, 212, and 214, while the second row includes panels 220, 222, and 224. Each panel is labeled with a circled number to show the order in which they were connected. In the illustrated example, panel 210 was connected first and is a full sheet. After panel 210 was connected, panel 212 was connected, with its leftward end in FIG. 9 extending under the rightward end of panel 210 to form an end lap. Panel 212 could also be a full panel. At the low end of the first row, panel 214 was cut to fit the remaining distance to joist 204, and was similarly connected under panel 212 to form an end lap. Then, panel 220 was cut to fit a shorter distance than panel 210, to ensure that end laps would be staggered. Panel 220 was then connected, extending under panel 210 to form a side lap. Then panel 222 was connected, and could be a full panel, with an end lap under panel 220 and side laps under panels 210 and 212. Similarly, to complete the second row, panel 224 was connected, after being appropriately cut, with an end lap under panel 222 and with side laps under panels 212 and 214. Subsequent rows could be connected in the same manner.

In some situations, a row by row sequence may not be optimal. One may instead choose to install panels from side to side. For example, panel 210 could be installed first, then panel 220, and so forth along the length of the joists to the other side of the deck. Then, panel 212 could be installed, followed by panel 222, and so forth across to the other side of the deck. Then, panel 214 could be installed, followed by panel 224, and so forth, until the panels have all been installed. In addition, it may be advantageous to mix installation, installing some panels row by row and others side to side.

Experience with installation of many underdeck drainage structures has shown that end laps such as those between panels 210 and 212, etc., should not be shorter than 4". In addition, to increase water tightness, end laps can be sealed with PVC cement or a clear silicon caulk. Longer end laps are not problematic, but may result in the need for additional panels. With sufficient planning, an arrangement of panels can be obtained in which a part of a panel cut off at the low end of one row can be used at the high end of the next row, reducing the number of panels required.

Figure 10:
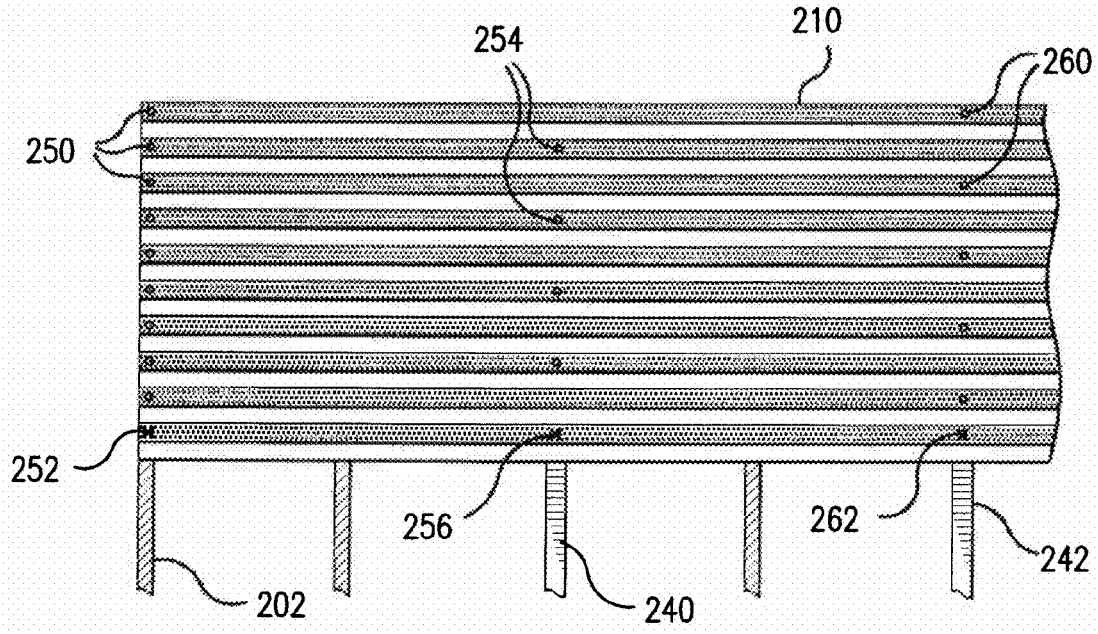
FIGS. 10 and 11 are partially schematic views from under a deck, showing two stages in the installation process of FIG. 8 that would occur prior to the stage shown in FIG. 9.

FIG. 10 illustrates in greater detail how panel 210 can be connected at the high end of the first row in FIG. 9. The shaded lines extending across panel 210 indicate parts of corrugations that are in contact with brackets, while the unshaded lines indicate parts of corrugations that are spaced away from brackets, thus providing channels for water flow. Screws that can be inserted before any subsequent panel is positioned are illustrated schematically by small circles or "O"s, while screws that can only be inserted after a subsequent panel is positioned are illustrated by small "X"s. As can be seen, screws have been inserted in joist 202 without a bracket as well as in joists 240 and 242, each of which has an attached bracket.

To connect panel 210 to joist 202, screws 250 are therefore first used to fasten panel 210 directly to the lower surface of joist 202. Then, screws 254 are inserted to fasten panel 210 at the lower surface of the bracket on joist 240. Similarly, screws 260 are then inserted to connect panel 210 at the lower surface of the bracket attached to joist 242. Subsequently, when panel 220 is positioned, screws 252, 256, and 262 can be inserted. In general, each of the screws can be inserted in the manner illustrated in FIGS. 3 and 7, and should not be inserted through the unshaded portion of panel 210, i.e. the parts of corrugations that are spaced away from the brackets, because that could result in leaking water.

FIG. 10 also illustrates that fasteners can be staggered, such as in the screws for joists 240 and 242. Screws 254 are in alternating corrugations, while screws 260 are in the other alternating corrugations, so that the two sets of screws are staggered. In the illustrated example, the two sets of screws are staggered "in a lengthwise direction of the joists", meaning that they are at different positions along the length of the respective joists rather than being in aligned pairs at counterpart positions in the lengthwise direction.

Figure 11:
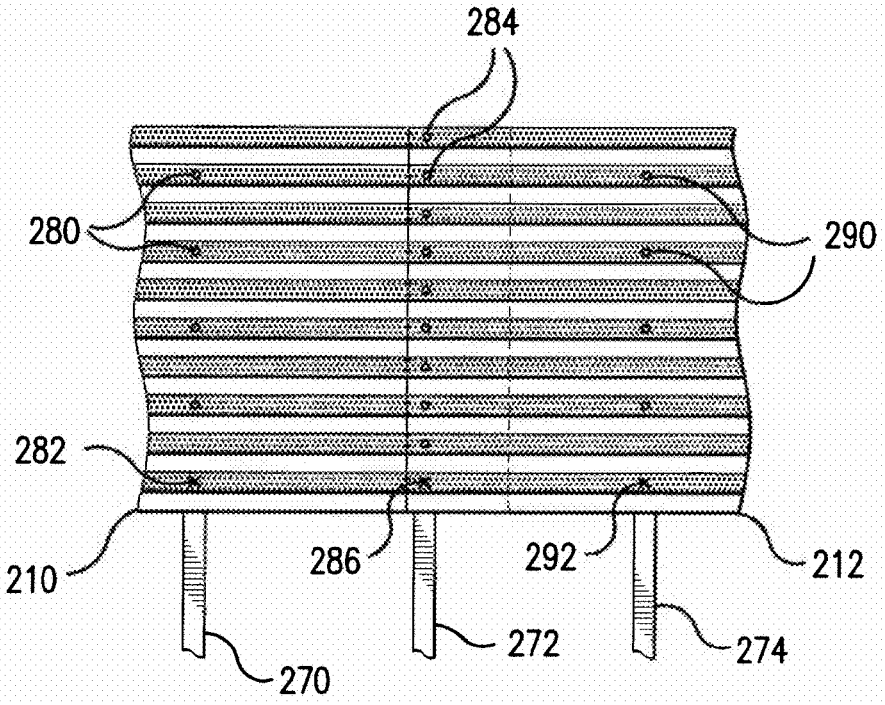

FIG. 11 illustrates the end lap between panels 210 and 212, with the same schematic features as in FIG. 10. Panel 210 is above panel 212 in FIG. 11 because, as shown in FIG. 9, panel 210 is at or near the high side of deck 200 while panel 212 is at or near the low side. Therefore, water would collect at the end lap if panel 212 extended over or above panel 210; this problem is avoided with panel 210 over panel 212 as shown. As used herein, a panel or other part or component is "at or near" a high or low part of a structure that has both high and low parts if it is nearer to the high or low part than it is to any of the other high and low parts of the structure.

In FIG. 11, joists 270, 272, and 274 all have brackets to allow adequate attachment at the end lap; more generally, it may be necessary to attach a bracket to every joist in some installations rather than to alternate joists as in FIG. 10. Following the same staggered pattern as shown in FIG. 10, screws 280 are inserted into the bracket attached to joist 270. Screws 284 are inserted when panel 212 has been positioned, and extend through the end lap into the bracket attached to joist 272; the solid line at the left of joist 272 shows the leftward end of panel 212, while the broken line at the right of joist 272 shows the rightward end of panel 210, above panel 212. Screws 290 are then inserted into the bracket attached to joist 274. Screws 282, 286, and 292 can be inserted after panel 220 has been connected and panel 222 is positioned.

FIG. 11, taken together with FIG. 9, illustrates how the staggering of end laps avoids a situation in which four panels must be fastened to a bracket by one screw. Screw 282 fastens panels 210, 220, and 222 to the bracket attached to joist 270, while screw 286 attaches panels 210, 212, and 222 to the bracket attached to joist 272.

The techniques illustrated in FIGS. 10 and 11 can be continued for subsequent panels in the first row and for the panels of subsequent rows in order to complete the operations in box 174 in FIG. 8. After all of the panels have been attached, gutters or other appropriate structures can be installed at the low end of deck 200 to collect and direct water flowing from the upper surfaces of the panels in a desired manner.

The techniques described above in relation to FIGS. 1-11 could be modified to provide a drainage direction that is parallel to joists rather than perpendicular. For example, brackets as described above or other hanging components could be attached to every joist, with downward distances changing along each bracket's length as necessary to obtain the desired slope. Then, equal thickness shim boards or other types of cross pieces could be attached to the brackets perpendicular to the joists to form a lattice-like structure; it would also be possible to use a sequence of stackable cross pieces of increasing thickness to modify the slope of the brackets, such as with extruded, hollow oblong PVC cross braces with a suitable set of thicknesses, such as 0.25", 0.5", 0.75", and 1.0", or ⅜", 9/16", ¾", etc.; the same approach could be used with cross braces made of other materials, such as wood. Finally, panels can be connected to the shim boards or other types of cross pieces, from the high part to the low part, similarly to the techniques described above.

The term "cross piece" is used herein generically to cover shim boards and other boards, parts, or components that extend approximately perpendicularly to hanging components to which they are connected. Where each hanging component extends in a respective joist's lengthwise direction and the joists are approximately parallel, a cross piece is also approximately perpendicular to the joists' lengthwise direction.

Figure 12:
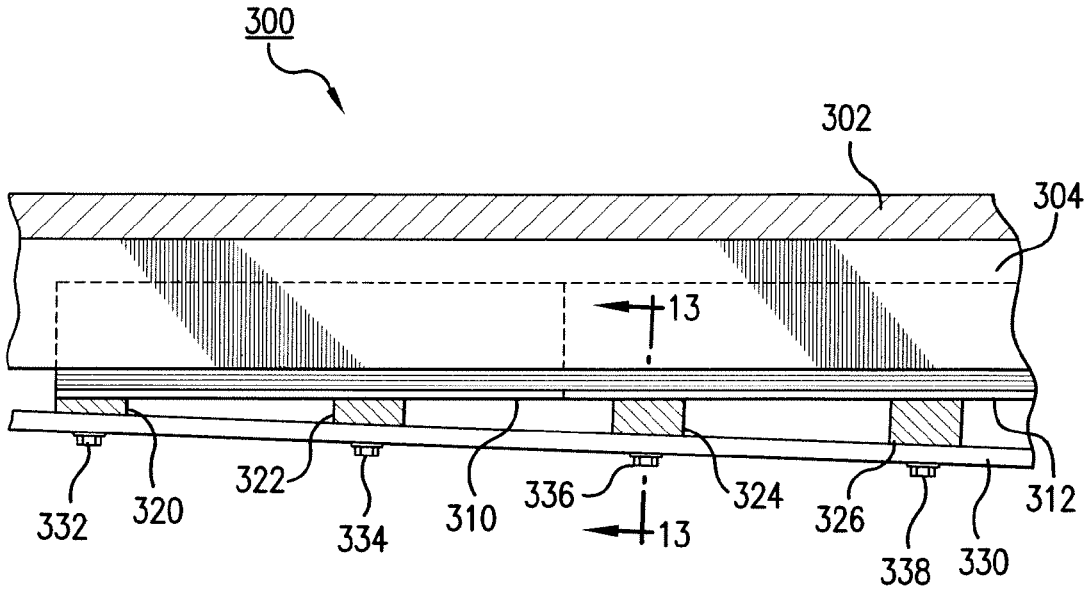
FIG. 12 is a partially schematic cross-sectional view of a deck similar to that in FIG. 1, but with a different underdeck drainage structure.

FIG. 12 shows a cross section of deck 300, a deck similar to deck 10 in FIGS. 1-3, but with corrugation direction approximately parallel to the lengthwise direction of joists. Floor board 302 is at the top, supported by a set of joists including joist 304. Brackets 310 and 312 are attached to joist 304 similarly to the attachment of bracket 52 to joist 18 in FIG. 3, with a sufficient downward distance to accommodate variation in the lower surfaces of joists and to satisfy any other constraints; for example, the downward distance could be as small as 0.5" or 1.0", or could be larger if appropriate. Boards 320, 322, 324, and 326 are attached to but approximately perpendicular to brackets 310 and 312, and have thicknesses that vary, providing a lattice-like structure with a lower surface that slopes in the slope direction. Cross pieces that function in this manner are sometimes described herein having thicknesses that vary "to provide slope". Corrugated panel 330 is attached to this lower surface by fasteners 332, 334, 336, and 338, which are illustratively screws but could be any other suitable fasteners.

Figure 13:
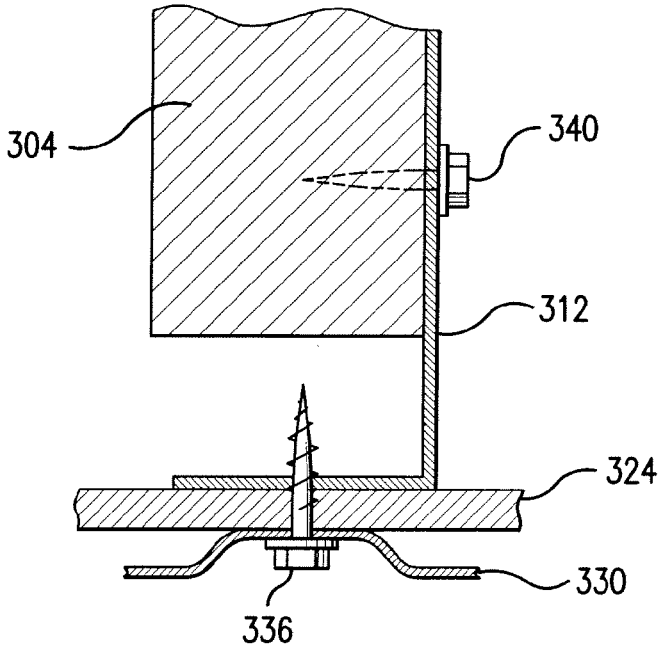
FIG. 13 is a cross-sectional view of the structure in FIG. 12, taken along the line 13-13.

FIG. 13 shows a cross section taken along the line 13-13 in FIG. 12. As shown in FIG. 13, bracket 312 is connected to joist 304 by screw 340, and by other screws or other suitable fasteners (not shown). Corrugations of panel 330 can also be seen in FIG. 13. The thickness of board 324 is suitable for turning screw 336 through panel 330, board 324, and the lateral leg of bracket 312.

In implementing the approach illustrated in FIGS. 12 and 13, the brackets that extend along each joist can be attached in sequence from the high end to the low end, continuing with substantially the same slope along the entire length of the joist. Then, the shim boards or other cross pieces, which also function as cross braces, can similarly be attached beginning at the high end and continuing to the low end, or in any other appropriate sequence. Then, the panels can be attached, such as row by row or side to side, in a manner that ensures appropriate side lapping and end lapping, as described above in relation to FIG. 8.

Figure 14:
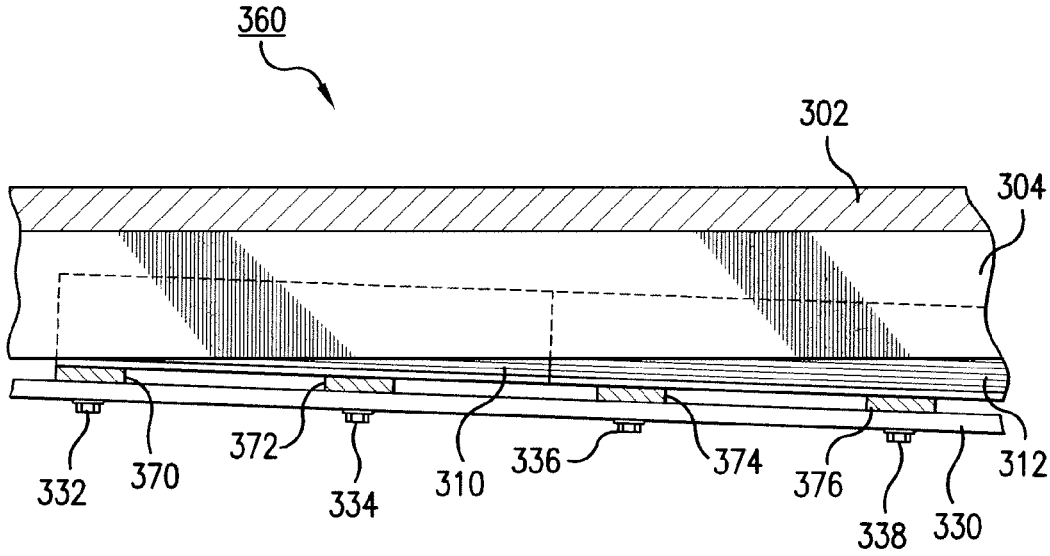
FIG. 14 is a partially schematic cross-sectional view of another deck similar to that in FIG. 12, but with a different underdeck drainage structure.

FIG. 14 shows a cross section of deck 360, a deck similar to deck 300 in FIG. 12, with corrugation direction again approximately parallel to the lengthwise direction of joists. In FIG. 14, some components similar to those in FIG. 12 are labeled with the same reference numerals. Brackets 310 and 312, although similar to those in FIG. 12, are attached to joist 304 with the downward distance increasing from left to right in FIG. 14 to produce an appropriate amount of slope. Boards 370, 372, 374, and 376 are attached to but approximately perpendicular to brackets 310 and 312, and have substantially equal thicknesses, providing another lattice-like structure with a lower surface as described above. Corrugated panel 330 is attached as in FIG. 12.

Figure 15:
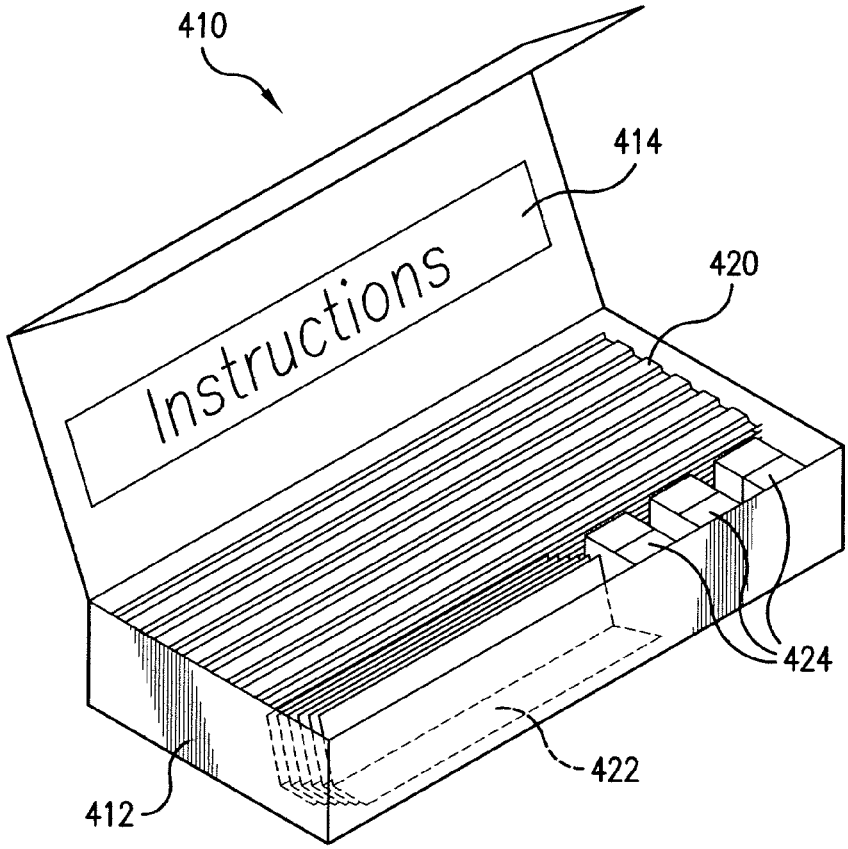
FIG. 15 is a perspective view of a product that includes parts and components that can be used to perform installation as in FIGS. 8-11.

FIG. 15 illustrates how parts and components for an underdeck drainage structure like those described above could be packaged in the form of product 410 with box 412. Box 412 holds unassembled parts or components and can also include instructions 414, illustratively shown on the lower surface of the lid of box 412 but which could also be provided as a separate sheet inserted into box 412. Box 412 is merely an illustrative container, and various other types of containers could be used.

Product 410 includes panels 420, brackets 422, and boxes 424 containing screws. As can be seen, panels 420 are corrugated and can be compactly stacked with their corrugations aligned. Similarly, brackets 422 and boxes 424 are positioned to occupy relatively little space. The arrangement shown is, of course, merely illustrative, and panels 420, brackets 422, and boxes 424 could be arranged in various other ways in boxes or other containers of various shapes.

Although it would be possible to market parts and components for underdeck drainage structures as illustrated in FIG. 15, the parts and components have been successfully marketed separately, with customers able to select the number of panels, brackets, and boxes of screws desired for their project. This approach is consistent with the technique described above in relation to box 170 in FIG. 8, because it allows a customer to obtain only a number of each item that is needed in accordance with the customer's estimate. In addition, the display of parts and components can also include tear-off sheets with instructions on installation similar to instructions 414 in FIG. 15.

Underdeck drainage structures implemented as described above can have many advantages. They can be simple, inexpensive, and easy to install, providing an elegant solution to underdeck drainage problems. They can be marketed with standard panels, brackets, and screws as described above. The corrugations in the upper surfaces of the panels can separate water and direct it in the desired drainage direction. In addition, the corrugations can provide structural strength and prevent bending, and the installation process described above can take advantage of the unique structural rigidity that can be obtained with corrugated panels. The brackets can provide downward distances that result in a desired slope even if the joists are uneven or otherwise irregular. Furthermore, although the techniques described above can be implemented with any suitable material, including plastic, metal, or wood, the use of plastic components can result in a clean appearance and eliminates rust problems with metal or rot problems with wood.

Underdeck drainage structures using the techniques described above have been successfully implemented with decks of many shapes and sizes. When properly installed, they stop drips into the underdeck area, keeping the underdeck area dry, useful, and looking great. Because of these features, the underdeck area stays clean and generally free of mold and mildew, providing a space that can be used for storage, as a patio, or for any other appropriate use. Furthermore, plastic corrugated panels such as Tuftex® panels from Tallant Industries, Inc., of Fredericksburg, Va., are fabricated so that they do not require painting to maintain color and can be cleaned by washing.

The implementations in FIGS. 1-14 illustrate examples of structures that perform drainage under decks with joists. Each structure includes a set of hanging components connected to hang from the joists and a set of panels under the joists. One or more of the hanging components each have connected first and second portions, and the first portion is connected to hang from a respective one of the joists and to extend downward to where it connects to the second portion which is below the respective joist. At least one of the panels has an upper surface with at least one corrugation extending in a corrugation direction. The second portion of a hanging component is connected to support at least one of the panels from above. The upper surfaces of the panels are sloped from a high part to a low part in a slope direction that is not perpendicular to the corrugation direction. The upper surfaces are sloped so that drainage across the upper surfaces occurs from the high part to the low part.

In specific implementations, the slope direction and the corrugation direction can be approximately the same. The upper surfaces can also be uniformly sloped. Each of the panels can have regular corrugations that extend in the corrugation direction. The first and second portions of each hanging component can be approximately perpendicular to each other. For example, each hanging component can be a bracket, such as an L-shaped bracket with first and second legs that are the first and second portions, respectively; the first and second legs can be connected at an angle of less than 90°. Each of the hanging components can alternatively have a U-shape with a base and first and second legs, with the first portion being the first leg and the second portion being the base; the second leg of the U-shape can also be connected to hang from the same joist. Each of the hanging components can alternatively have an inverted T-shape with a leg and two arms; the first portion can be the leg and the second portion can be one arm of the T-shape. Each of the hanging components can be an integrally formed plastic or metal piece.

In further specific implementations, the first portion of at least one hanging component can be connected at a lateral surface of the respective joist, with the second portion having downward distance below the joist's lower surface. A first set of fasteners can connect the first portion at the joist's lateral surface, while a second set of fasteners can connect the second portion to support one or more of the panels from above. The fasteners can be screws, nails, bolts, staples, glue, cement, adhesive, welded or soldered beads, or adhesive tape. Each of the panels can have upper and lower surfaces and at least one fastener in the second set can extend from below the lower surface of one of the panels through the panel and from the upper surface of the panel into the second portion of a hanging component. Alternatively, the structure can include cross pieces connected to the second portion and extending approximately perpendicularly to the slope direction; in this case, a fastener in the second set can extend from below the lower surface of one of the panels through the panel and from the panel's upper surface into one of the cross pieces.

In further specific implementations, each joist can extend in a respective lengthwise direction approximately perpendicular to the corrugation direction, and a panel can have periodic corrugations with periods having an average width W transverse to the corrugation direction; the second part of each of the hanging components can extend in the joist's lengthwise direction a distance greater than approximately W. Alternatively, each joist can extend in a lengthwise direction approximately parallel to the corrugation direction; cross pieces can extend approximately perpendicularly to the lengthwise direction, each connected at its upper surface to second portions of hanging components and at its lower surface to one or more panels.

In further specific implementations, at least one of the panels can be connected at a lower surface of a joist without a hanging component. The set of panels can include two or more contiguous, overlapping panels so that the upper surfaces form a substantially uninterrupted drainage surface. A first panel can be positioned toward the high part relative to an adjacent, overlapping panel, with the first panel overlapping above the second.

The implementations described in relation to FIGS. 1-14 above also illustrate examples of a method of constructing a structure for drainage under decks that have joists. The method includes connecting a set of hanging components to hang from respective joists under a deck. The method also includes connecting a set of panels so that the panels are under the joists. In connecting the hanging components, the method includes, for hanging components that have connected first and second portions, connecting the first portion to hang from the respective joists and to extend downward to where it connects to the second portion, which is below the respective joist. Connecting the panels includes, for at least one of the panels, connecting the second portion of at least one of the hanging components to support the panel from above. After the method connects the hanging components and the panels, the upper surfaces of the panels are sloped from a high part to a low part in a slope direction not perpendicular to the corrugation direction. The upper surfaces are sloped so that drainage across the upper surfaces occurs from the high part to the low part.

In specific implementations, the act of connecting the panels can include, for at least one of the panels at or near the high part, connecting the panel at a lower surface of one of the joists without a hanging component. The panels can also be connected so that panels that are adjacent in the slope direction overlap by at least approximately 4". A panel at or near the high part can be connected before connecting a panel at or near the low part. The first portion of one of the hanging components can be connected at a lateral surface of a respective joist. In connecting the second portion, fasteners can be staggered in a lengthwise direction of the joists for adjacent hanging components.

In further specific implementations, the first portions of all of the hanging components can be connected before any of the second portions are connected. After the first portions are all connected, the second portions can have downward distances below the joists such that there is at least 1" of fall for every 10' of run from the high part to the low part. If the joists extend approximately perpendicularly to the slope, the first portions can be connected in sequence from the high part to the low part, with the second portion of each hanging component having downward distance such that it is approximately ¼" lower than the second portion of a preceding hanging component in the sequence. If the joists are approximately parallel to the slope, the second portion can have downward distance, and the downward distance can slope in the respective joist's lengthwise direction; also, cross pieces can be connected approximately perpendicular to the joists, each connected at its upper surface to second portions of hanging components and at its lower surface to at least one of the panels, and the cross pieces can have thicknesses that vary to provide slope.

Implementations as in FIG. 15 illustrate examples of a product to enable construction of structures that provide drainage under decks that have joists. The product includes a container and, in the container, hanging components and panels as described above. In specific implementations, a product can also include, in the container, instructions for connecting the hanging components to hang from joists and for connecting the second portion of the hanging components to support the panels from above. Also, the product can include, in the container, fasteners that can be used to connect first portions of hanging components to hang from joists and to connect second portions of hanging components to support the panels from above.

The exemplary implementations relate to applications to drainage under decks adjoining buildings, but techniques like those described above might find use in other applications.

The exemplary implementations described above are illustrated with specific shapes, dimensions, and other characteristics, but the scope of the invention includes various other shapes, dimensions, and characteristics. For example, the particular shape of hanging components could be different, and could be of appropriate sizes for any particular combination of joists. Also, hanging components could be connected to hang from joists in a variety of ways, and could provide uniform slope at any of various values or slope that varies as a function of position, i.e. non-uniform slope; for example, rather than providing drainage entirely to one side, a structure could have a high part below the center of a deck and could slope downward in each direction from the high part. Furthermore, rather than being extruded plastic, hanging components as described above could be manufactured in various other ways and could include various other materials, including various other plastics and also various metals. Similarly, panels could be metal rather than plastic.

Similarly, the exemplary implementations described above include specific examples of panels, hanging components, and fasteners, but any appropriate panels, hanging components, and fasteners could be employed. Further, the above exemplary implementations employ specific sequences of operations in constructing structures, but a wide variety of other such sequences of operations could be used within the scope of the invention, including additional operations, omitting some operations, or performing operations in a different order. The invention is not limited to the specific examples of rectangular decks with wooden joists, but could be used with other decks with various other shapes and sizes and supported by joists made of other materials.

While the invention has been described in conjunction with specific exemplary implementations, it is evident to those skilled in the art that many alternatives, modifications, and variations will be apparent in light of the foregoing description. Accordingly, the invention is intended to embrace all other such alternatives, modifications, and variations that fall within the spirit and scope of the appended claims.

What is claimed is:

1. A method of constructing a structure for drainage under decks that have joists, the structure forming a continuous ceiling concealing the joists; the method comprising:

connecting a set of hanging components to hang from respective joists under a deck; the act of connecting the hanging components including:

for one or more of the hanging components that each have connected first and second portions, connecting the first portion to hang from the respective joist and to extend downward to where it connects to the second portion; at least one of the hanging components having an L-shape with the first and second portions being legs of the L-shape and being connected at an angle of less than 90 degrees; the second portion being below the respective joist; and connecting a set of panels so that the panels are under the joists; at least one panel in the set having an upper surface with at least one corrugation extending in a corrugation direction; the act of connecting the panels including, for at least one of the panels:

connecting the second portion of at least one of the hanging components to support the panel from above;

after the acts of connecting the hanging components and the panels, the upper surfaces of panels in the set being sloped from a high part to a low part in a slope direction not perpendicular to the corrugation direction; the upper surfaces having slope sufficient that drainage across the upper surfaces occurs from the high part to the low part;

the act of connecting the panels further including:

positioning the panels to cover a total area under the deck so that none of the joists are visible between panels and subsets of contiguous panels overlap with the upper surfaces of all the panels in the set forming a substantially uninterrupted drainage surface under the joists.

2. The method of claim 1 in which the act of connecting the panels further includes, for at least one of the panels at or near the high part:

connecting the panel at a lower surface of one of the joists without a hanging component.

3. The method of claim 1 in which the act of connecting the panels further includes:

connecting the panels so that panels that are adjacent in the slope direction overlap by at least approximately 4 inches.

4. The method of claim 1 in which the act of connecting the panels further includes:

connecting a panel at or near the high part before connecting a panel at or near the low part.

5. The method of claim 1 in which the act of connecting the first portion comprises:

connecting the first portion at a lateral surface of the respective joist.

6. The method of claim 1 in which the act of connecting the second portion includes staggering fasteners in a lengthwise direction of the joists in connecting second portions of adjacent hanging components.

7. The method of claim 1 in which the act of connecting the first portion is performed for all of the hanging components that have first and second portions before any act of connecting the second portion.

8. The method of claim 7 in which, after the act of connecting the first portion is performed for all of the hanging components that have first and second portions, the second portions having downward distances below the respective joists such that there is at least one inch of fall for every 10 feet of run from the high part to the low part.

9. The method of claim 7 in which the joists all extend approximately in a lengthwise direction approximately perpendicular to the slope direction; the act of connecting the first portion being performed for hanging components in sequence from the high part to the low part, with the second portion of a hanging component in the sequence having downward distance below the respective joist such that the second portion is approximately one-quarter of an inch lower than the second portion of a preceding hanging component in the sequence.

10. The method of claim 7 in which each joist extends in a respective lengthwise direction approximately parallel to the slope direction, each of the hanging components extending in the lengthwise direction of the respective joist; the act of connecting the first portion being performed so that the second portion has downward distance below the respective joist.

11. The method of claim 10 in which the second portion of each hanging component has downward distance that slopes in the respective lengthwise direction.

12. The method of claim 10, further comprising, after the act of connecting the hanging components and before the act of connecting the panels:

connecting cross pieces extending approximately perpendicularly to the lengthwise direction of the joists, with each cross piece being connected at its upper surface to the second portions of a subset of the hanging components;

the act of connecting the panels comprising:

connecting one of the panels to a set of the cross pieces, with at least one cross piece in the set being connected at its lower surface to the panel.

13. A method of constructing a structure for drainage under decks that have joists, the structure forming a continuous ceiling concealing the joists; the method comprising:

connecting a set of hanging components to hang from respective joists under a deck; the act of connecting the hanging components including:

for one or more of the hanging components that each have connected first and second portions, connecting the first portion to hang from the respective joist and to extend downward to where it connects to the second portion; the second portion being below the respective joist;

connecting a set of panels so that the panels are under the joists; at least one panel in the set having an upper surface with at least one corrugation extending in a corrugation direction; the act of connecting the panels including, for at least one of the panels:

connecting the second portion of at least one of the hanging components to support the panel from above;

the act of connecting the first portion is performed for all of the hanging components that have first and second portions before any act of connecting the second portion;

after the acts of connecting the hanging components and the panels, the upper surfaces of panels in the set being sloped from a high part to a low part in a slope direction not perpendicular to the corrugation direction; the upper surfaces having slope sufficient that drainage across the upper surfaces occurs from the high part to the low part;

the act of connecting the first portion being performed so that the second portion has downward distance below the respective joist; each joist extends in a respective lengthwise direction approximately parallel to the slope direction, each of the hanging components extending in the lengthwise direction of the respective joist;

the act of connecting the panels further including:

positioning the panels to cover a total area under the deck so that none of the joists are visible between panels and subsets of contiguous panels overlap with the upper surfaces of all the panels in the set forming a substantially uninterrupted drainage surface under the joists;

after the act of connecting the hanging components and before the act of connecting the panels:

connecting cross pieces extending approximately perpendicularly to the lengthwise direction of the joists, with each cross piece being connected at its upper surface to the second portions of a subset of the hanging components; the cross pieces have thicknesses between upper surfaces of the panels and lower surfaces of the second portions of hanging components; the thicknesses of the cross pieces varying to provide slope in the slope direction;

the act of connecting the panels comprising:

connecting one of the panels to a set of the cross pieces, with at least one cross piece in the set being connected at its lower surface to the panel.

* * * * *